United States Patent [19]

Brathwaite

[11] Patent Number: 4,814,220

[45] Date of Patent: Mar. 21, 1989

[54] COUNTERTOP FABRICATION SYSTEM

[76] Inventor: John F. C. Brathwaite, R.R. #2, Almonte, Ontario, Canada, K0A 1A0

[21] Appl. No.: 83,073

[22] Filed: Aug. 10, 1987

[51] Int. Cl.[4] ..... B32B 31/04

[52] U.S. Cl. ..... 428/119; 52/827; 156/293

[58] Field of Search ..... 52/827; 156/293; 428/60, 119, 133, 120

[56] References Cited

U.S. PATENT DOCUMENTS

| | | | |
|---|---|---|---|
| 1,167,155 | 1/1916 | Derby | 52/827 |
| 3,176,353 | 4/1965 | Pilliod et al. | 52/827 X |
| 3,382,124 | 5/1968 | Briskey | 156/202 |
| 3,729,368 | 4/1973 | Ingham et al. | 428/151 X |
| 4,137,115 | 1/1979 | Lambert | 156/293 X |
| 4,444,809 | 4/1984 | Rau | 52/827 X |

FOREIGN PATENT DOCUMENTS

| | | | |
|---|---|---|---|
| 1013532 | 7/1977 | Canada . | |
| 524719 | 8/1985 | Canada . | |
| 58-59809 | 4/1983 | Japan | 428/133 |

*Primary Examiner*—Henry F. Epstein
*Attorney, Agent, or Firm*—Larson & Taylor

[57] ABSTRACT

A system for the fabrication of edging configurations on countertops and the like employs an elongate edge moulding element having a continuous rib thereon. A complementary groove is provided parallel to the edge of the countertop sheet on the underside of the sheet to receive the rib and locate the edge moulding element reliably and accurately for the glueing operation.

17 Claims, 2 Drawing Sheets

COUNTERTOP FABRICATION SYSTEM

BACKGROUND OF THE INVENTION (a) Field of the Invention

This invention relates to a new system for the fabrication of countertops or the like, and to an edge moulding element for use in this system.

(b) Description of the Prior Art

Domestic countertops used in kitchens, bathrooms and the like have hitherto usually been fabricated as plastic laminates on fiber-board backing or as gel-coated synthetic marbles. Typically these have had finishes of no more than 0.062-inch thickness so that they cannot withstand sanding or polishing to remove traces of heavy wear or other damage.

In more recent times, solid surfacing sheets of man-made material, generally of polyester or acrylic composition, have become available. These are typically supplied in ½-inch and ¾-inch thicknesses and are intended for fabrication into horizontal countertops (their major area of use) and vertical wall surfaces, as in tub and shower surrounds, and for use in some furniture applications. These sheets are homogeneous in nature, and besides offering a stain and chemical resistance that is far superior to any natural products, have the advantage that surface scratches and marks such as produced by knife cuts or cigarette burns can be sanded and polished out to leave no visible change in the colour or texture of the surface. Sheet material of this type is sold by, among others, DuPont Corporation under the trademark CORIAN, Avonite Corporation under the trademark AVONITE, Nevamar Corporation under the trademark FOUNTAINHEAD, Cyanamid Limited under the trademark 2000X and Laurentian Industries (North Bay) Limited under the trademark SOLIDEX.

In the fabrication of countertops and like applications such as table tops and mantel pieces, it is usually desirable to provide an edge treatment that is very much thicker than the stock thickness of the sheet; typically it will be at least 1.5 inches. To satisfy this requirement, the fabricator cuts the sheet material to the required size and shape for the product being made, and then cuts and glues to the edge of the sheet additional strips of sheet material in order to build up sufficient thickness or mass to permit the required edge detail to be formed. Apart from the labour involved in cutting and gluing the edge strips, the process is complicated by the need to ensure that the edge strips do not shift out of position when clamp pressure is applied to maintain contact between the strips and the sheet while the glue is curing. In some procedures, temporary stop blocks are first glued to the underside of countertop to prevent the edge strips from shifting when the strips are being glued. Moreover the wet glue joint is susceptible to permanent discoloration if it becomes soiled, for example, by contact with dirty fingers when the fabricator attempts to verify or ensure proper alignment between the edge strip and the sheet. If two or more layers of edge strip are required, such difficulties are multiplied. Fabrication is further delayed by the fact that some of the specialized adhesives require between two and eight hours to cure before any further layering or processing can be performed. The difficulties increase wherever corners are required.

The demand for accuracy and extreme care in fitting edge strips to countertops means that skilled workers are required for the task, and accordingly the cost of the finished product reflects their high wages.

The aim of the invention is to provide an improved edge moulding element and a new fabrication system that will alleviate the difficulties described above.

SUMMARY OF THE INVENTION

According to the invention an edge moulding element is provided for use in the fabrication of counter tops and the like, comprising: a straight elongate strip of substantially constant profile, said strip including at least one straight longitudinally extending flat surface and projecting rib means extending longitudinally on said flat surface.

Preferably, the edge moulding element is essentially rectangular in cross-section and is fabricated in a solid homogeneous plastics material suitably of plyester or acrylic of the same composition as the sheet material. The rib is positioned on the surface of the element such that when it is engaged in a complementary groove on the underside of the flat sheet parallel to the edge of the sheet, then an adjacent surface of the moulding element is in a desired orientation, e.g. parallel to the edge of the sheet. Typically the edge moulding element may have a second rib on a surface opposite to the first surface, so that when the moulding element is turned so that this second rib is engaged in the groove, the fourth surface of the moulding element is positioned adjacent the edge of the sheet. The moulding element can be configured such that the surface presented adjacent the sheet edge is of any desired configuration, e.g. it may be flat, grooved, recessed, rounded, chamfered, etc. Alternatively, once the edge moulding element has been bonded to the sheet, a suitable edge profile or configuration can be formed in it by machining or the like.

In some instances it may be desirable to buildup an edge detail from two or more moulding elements, and in this case the moulding element that is attached to the flat sheet may itself be formed with a groove to provide a location means for a second edge moulding element that is to be bonded to the first element.

The invention also provides the combination of an edge moulding element as described above with the flat sheet member formed with a groove parallel to its edge to receive the rib of the edge moulding element.

From another aspect the invention provides a method of fabricating an edge moulding on a countertop or the like comprising: providing a flat sheet of material having a straight edge thereon and a groove on the underside of said sheet extending parallel to said edge at a predetermined distance therefrom; providing an edge moulding element of substantially constant profile, said element having a flat surface extending longitudinally thereof, projecting rib means extending longitudinally on said flat surface, and a nose surface adjacent to one side of said flat surface; positioning said edge moulding element with said flat surface in contact with the surface of the underside of the flat sheet and the rib means in engagement with said groove thereby to locate said nose surface at a desired location relative to said edge; and securing said edge moulding element thus positioned to said flat sheet.

Preferably the edge moulding element is secured to the flat sheet by adhesive bonding with the aid of clamp means. After bonding the built-up edge moulding can be further formed by machining to the desired profile.

BRIEF DESCRIPTION OF THE DRAWINGS

The invention will be further described, by way of example only, with reference to certain preferred embodiments that are illustrated in the accompanying drawings, wherein.

DESCRIPTION OF THE PREFERRED EMBODIMENTS

Figure 1:
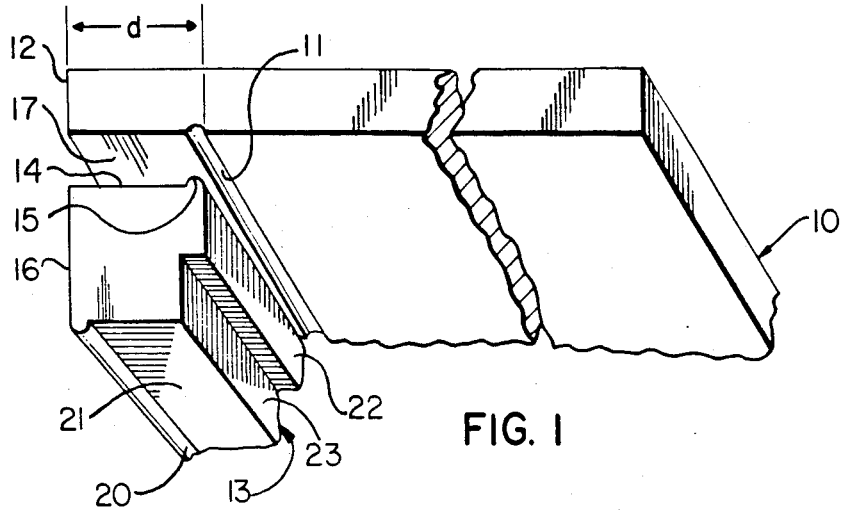
FIG. 1 is a fragmentary underneath perspective view illustrating a stage in the fabrication of a countertop edging.

FIG. 1 illustrates a stage in the fabrication of a countertop wherein a flat sheet 10 of suitable plastic stock material such as Solidex of a uniform standard thickness (as illustrated of 0.5 inches) is formed with a continuous groove 11 at a predetermined spacing d from the edge 12 of the sheet that is to constitute the front edge of the countertop. The groove 11 may be formed at the time of manufacture of the sheet 10, or may be formed subsequently, e.g. by routing by the fabricator. The groove may be of any desired shape, and as illustrated is of rounded form having a width of approximately 0.125 inches and a depth of 0.062 inches.

Figure 2:
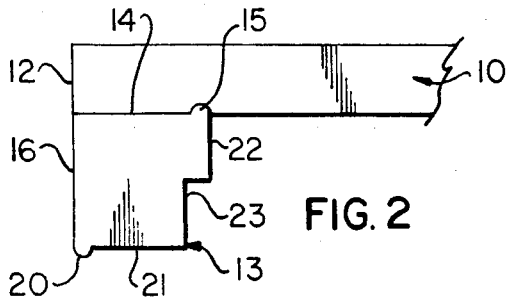
FIG. 2 is an end view showing the elements of the countertop in assembled and finished condition.

An edge moulding element 13 is of generally rectangular configuration having a constant profile throughout its length, and has one flat surface 14 on which is provided a longitudinally extending rib 15. Adjacent one side of the surface 14 is moulding-element front surface 16 that is spaced from the rib 15 by the distance that is slightly less than d. The rib 15 is of a shape complementary to that of the groove 11 so that when the surface 14 of the edge moulding is brought into contact with the margin 17 of the underside of the sheet 10 with the rib 15 received in the groove 11, then the front surface 16 of the edge moulding element is registered with the front edge 12 of the sheet. In practice the surface 16 is set back from the front edge 12 by a distance of about 0.062 inches and after assembly this amount of material is removed from the edge 12 in a finishing operation to make it flush with the surface 16 as shown in FIG. 2. In this way any minor imperfections present in the edge of the sheet stock such as nicks, dents, scratches and other blemishes are removed.

The edge moulding element 13 has a second rib element 20 projecting from the surface 21 that is opposite and parallel to the surface 14 at the side thereof adjacent the surface 16. The remaining surface 22 of the element 13 is parallel to the surface 16 and is formed with a large stepped recess 23. The element 13 can be glued to the sheet 10 in an orientation inverted from that shown in FIG. 2, i.e. with the surface 21 glued to the margin 17, and in this case the surface 22 will be register with the edge 12 of the sheet, and the recess 23 will define a continuous rectangular indentation or recess extending therealong. This configuration is illustrated in FIG. 4*c* where a decorative strip inlay 24 is positioned in the recess.

The moulding element 13 is made from the same material (e.g. Solidex) as the sheet 10 and can be fabricated by any desired means such as moulding, extrusion or machining from solid stock. In the example illustrated in FIGS. 1 and 2 the moulding element 13 is approximately 1 inch square, and the recess 23 approximately 0.187 inches deep by 0.5 inches wide. Thus the thickness of the edge formation as shown in FIG. 2 is slightly greater than 1.5 inches. If a thicker edge formation is required, it can be achieved by providing a higher edge moulding element or by building up the edge using a plurality of glued-on elements.

Figure 3:
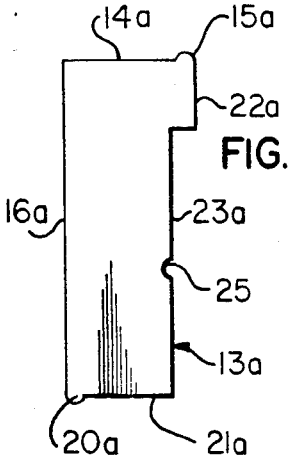
FIG. 3 is an end view showing an alternative edge moulding element.

FIG. 3 shows a modified edge moulding element 13*a* that is of increased height, having a recess 23*a* of approximately 2 inches so that the total depth of the element 13*a* is approximately 2.562 inches, the width being the same as element 13 of FIGS. 1 and 2. As before, the element 13*a* has two ribs 15*a* and 20*a* on opposite sides thereof, either of which may be engaged in the groove 11 in the sheet 10, the corresponding faces 14*a*, 21*a* being glued to the margin 17 to present a front face 16*a* or 22*a* in register with the edge 12. A longitudinally extending groove 25 is formed in the recess 23*a*, this groove being of similar configuration to the groove 11.

Figure 4A:
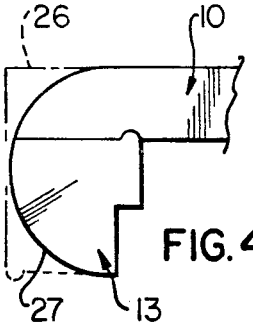
FIGS. 4*a*, 4*b* and 4*c* are views corresponding to FIG. 2 showing modified arrangements.
Figure 4B:
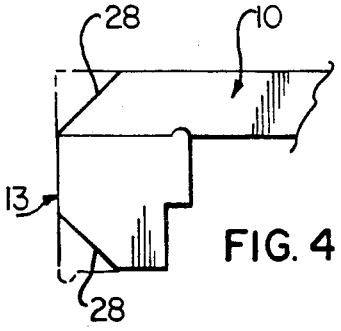
Figure 4C:
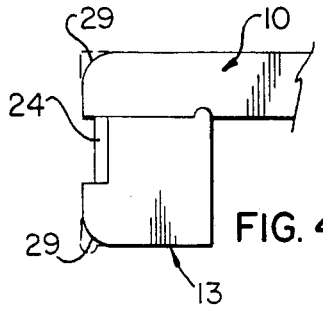

FIGS. 4*a*, 4*b* and 4*c* show just a few of the large variety of edge configurations that can be achieved by glueing an edge moulding 13 to the sheet 10. After fabricating the joint by glueing, as described in relation to FIG. 2, and after the glue has set, the edge can be machined to remove the excess material as represented by the broken lines 26, to produce a continuously rounded surface 27. Alternatively the edge of the sheet 10 and the lower portion of element 13 can be chamfered as shown at 28 in FIG. 4*b*. Instead of a chamfer, a radius may be formed on these edges as illustrated at 29 in FIG. 4*c*.

Figure 5A:
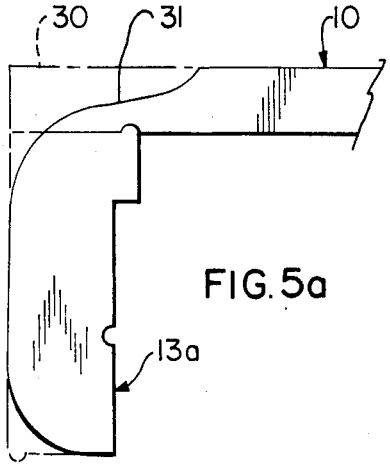
FIGS. 5*a*, 5*b* and 5*c* are views, similar to FIG. 2, showing modified arrangements utilizing the alternative edge moulding element of FIG. 3.

FIG. 5*a* shows an edge configuration that can be achieved by applying a moulding 13*a* as shown in FIG. 3 to the edge of the sheet 10. After glueing, unwanted material as indicated by the broken lines 30 is machined away to provide the desired profile 31.

Figure 5B:
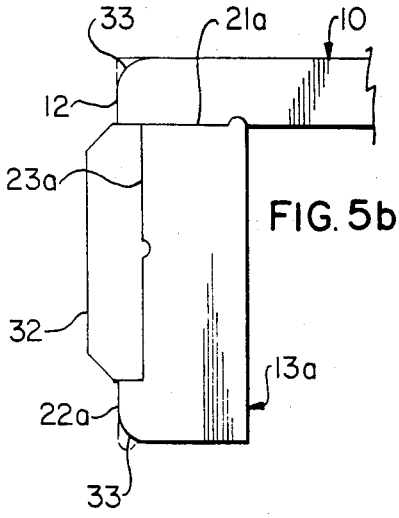
Figure 5C:
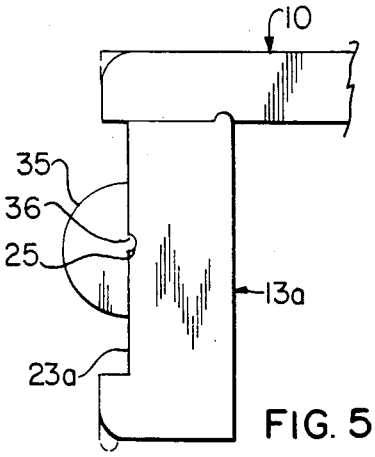

FIG. 5*b* is similar to FIG. 5*a* but shows the moulding element 13*a* applied in inverted fashion with the face 21*a* glued to the sheet 10 so the face 22*a* is registered with the front edge 12. A wood or decorative inlay 32 is received in the recess 23*a*, and the top and bottom corners are radiussed as shown at 33. The arrangement in FIG. 5*c* is similar to that of FIG. 5*b*, except for the use of a half-round inlay 35 in the recess 23. The inlay 25 can be formed of any suitable wood or decorative moulding material, and includes a rib 36 that is received in the groove 25 to assist in locating the inlay 35 at the desired position in the recess 23*a*.

Figure 6:
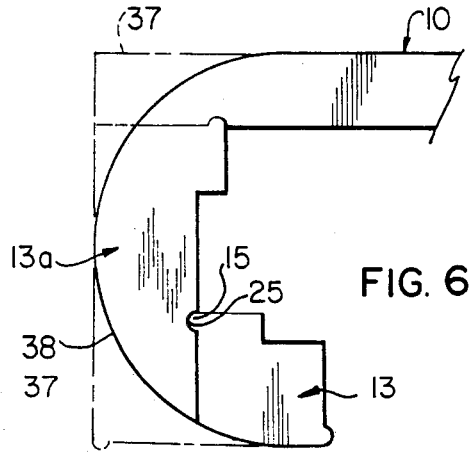
FIG. 6 shows a compound edge moulding configuration.

FIG. 6 shows an alternative composite configuration in which a deep and solid-looking curved edging is provided on the countertop sheet 10 by a compound arrangement of edge moulding elements. Specifically, an edge moulding element 13*a* is glued to the sheet 10, after which an edge moulding element 13 is glued to the element 13*a* in the orientation shown with the rib 15 received in the groove 25 within the recess 23*a*. In this case the excess material indicated by the broken lines 37 is machined away to provide a curved surface 38 having a large radius of curvature, as shown approximately 1.5 inches, and a correspondingly massive appearance.

From the foregoing description it will be understood that endless variations of countertop configurations can be devised using the basic edge mouldings disclosed. Typically the sheet stock 10 as produced at the casting factory will be manufactured with a single groove 11 close to one edge thereof. The resulting sheet is not otherwise be altered in any way that would affect shipping, storage or handling. The groove 11 would produce only an insignificant weakening of the material, and this weakening would be made good once the matching moulding element was glued in place.

In use, to produce a countertop or other articles with built-up edges, the fabricator places a sheet 10 of grooved countertop material upsidedown on a work surface. The sheet 10 is cut to size and provided with other grooves 11 as required. For example, a peninsula counter would require finished edges on three sides, so that two additional grooves would have to be cut in the underside of the sheet, e.g. by the use of a standard router aligned against a straight edge.

The glueing process is done in the normal way but with the elements 13 and 13*a* of the present invention it will not normally be necessary to apply multiple layers of sheet material to achieve the desired appearance of bulk. More importantly, the moulded edges cannot slip out of register when clamp pressure is applied to the glued joint, so that the fabricator does not have to finger the joint to feel if the edges are properly aligned. Difficult corners can be glued at the same time as straight edges since by virtue of the rib and groove arrangement the joints cannot slide out of alignment.

Wherever the ends of the grooves 11 in the sheet(s) 10 would be exposed, e.g. at certain types of corners such as a right-angle corner where an additional groove 11 has been cut in the sheet material at a right angle to the original groove 11 the two edge moulding elements meeting in a mitred angled, the ends of the grooves 11 in the sheet 10 are covered with tape so that the adhesive employed (which preferably is the same polyester or acrylic composition used to form the sheet) fills the holes and does not flow from them. When the glue has cured, a common flushcutting router is employed to remove any squeezed-out glue or other imperfection from the sheet-stock edge.

Applicant believes that the use of the moulding elements and fabrication system herein disclosed is effective in reducing the fabrication time required by up to 40%. Furthermore, less skilled fabricators can be employed so that labour costs are lower, which also results in a saving to the user. Furthermore, the finished edging achieved through the use of this system is substantially stronger than edge constructions achieved using prior fabrication techniques.

What I claim as my invention is:

1. For use in the fabrication of counter tops and the like formed from sections of flat sheet material, an edge moulding element comprising:

a straight elongate strip of substantially constant profile, said strip including at least one straight longitudinally extending flat surface and projecting rib means extending longitudinally with respect to said flat surface and projecting outwardly thereof, the arrangement being such that said rib means can be inserted in a groove provided on the underside of a section of said flat sheet material parallel to an edge thereof to locate said edge mounting element in a predetermined location relative to said edge.

2. An edge moulding element according to claim 1 fabricated in solid homogeneous plastics material.

3. An edge moulding element according to claim 1 wherein said rib means has a rounded profile.

4. An edge moulding element according to claim 1 wherein said rib means is continuous throughout the length of the element.

5. An edge moulding element according to claim 1 wherein said rib means is located along one side of said flat surface, adjacent a second surface of the element that is at right angles to said flat surface.

6. An edge moulding element according to claim 1 wherein a major portion of the profile of the element apart from said one flat surface is rounded.

7. An edge moulding element according to claim 1 including a second longitudinally extending flat surface opposite and parallel to said first mentioned flat surface and also having a projecting rib means associated therewith.

8. An edge moulding element according to claim 1 wherein adjacent to opposite edges of said flat surface are two further flat surfaces at right angles thereto.

9. A edge moulding element according to claim 1 wherein the profile is rectangular.

10. An edge moulding element according to claim 9 wherein there is a chamfer between two surfaces of the moulding element other than said flat surface.

11. An edge moulding element according to claim 9 wherein there is a rounded intersection between two surfaces of said element other than said flat surface.

12. An edge moulding element according to claim 9 wherein in a surface of said element at right angles to said flat surface there is a longitudinally extending groove of a profile complementary to that of said rib means.

13. An edge moulding element according to claim 9, having a right-angled longitudinally extending recess at a corner between two surfaces other than said flat surface.

14. A countertop comprising a flat sheet of homogeneous plastics material having a straight edge thereon, and an edge moulding element according to claim 9 of the same material as said sheet, said sheet having a continuous groove extending thereon at a predetermined distance from said straight edge and adapted to receive said rib means therein such that when the rib means is so received, a second surface of said edge moulding element is positioned at a desired location relative to said straight edge.

15. A method of fabricating an edge moulding on a countertop or the like comprising:

providing a flat sheet of material having a straight edge thereon and a groove extending parallel to said edge at a predetermined distance therefrom;

providing an edge moulding element of substantially constant profile, said element having a flat surface extending longitudinally thereof, projecting rib means extending longitudinally on said flat surface, and a nose surface adjacent to one side of said flat surface;

positioning said edge moulding element with said flat surface in contact with the surface of the underside of flat sheet and the rib means in engagement with said groove thereby to locate said nose surface at a desired location relative to said edge; and securing said edge moulding element thus positioned to said flat sheet.

16. A method according to claim 15 wherein said securing effected by adhesive bonding.

17. A method according to claim 15 wherein said edge moulding element and said flat sheet are both of plastics material, and said securing is effected by adhesive bonding with the aid of clamp means.

* * * * *